United States Patent [19]

Graf

[11] Patent Number: 4,972,552

[45] Date of Patent: Nov. 27, 1990

[54] CARD FLAT SEGMENT HAVING A DIRT SEPARATOR FOR CARDING MACHINES

[75] Inventor: Ralph A. Graf, Freienbach, Switzerland

[73] Assignee: Graf & Cie AG, Rapperswil, Switzerland

[21] Appl. No.: 412,273

[22] Filed: Sep. 25, 1989

[30] Foreign Application Priority Data

Oct. 12, 1988 [CH] Switzerland ..... 3810/88

[51] Int. Cl.[5] ..... D01G 15/24

[52] U.S. Cl. ..... 19/113; 19/114

[58] Field of Search ..... 19/107, 112, 113, 114

[56] References Cited

U.S. PATENT DOCUMENTS

| | | | |
|---|---|---|---|
| 3,148,415 | 9/1964 | Reiterer | 19/113 |
| 4,297,768 | 11/1981 | Löffler | 19/113 |
| 4,321,788 | 3/1982 | Alston | 19/114 |
| 4,355,439 | 10/1982 | Estebanell | 19/107 |
| 4,400,852 | 8/1983 | Löffler | 19/107 |
| 4,438,549 | 3/1984 | Silander | 19/113 |
| 4,593,437 | 6/1986 | Graf et al. | 19/113 |

FOREIGN PATENT DOCUMENTS

| | | | |
|---|---|---|---|
| 3336601 | 4/1985 | Fed. Rep. of Germany | 19/114 |
| 2242492 | 3/1975 | France . | |

*Primary Examiner*—Andrew M. Falik
*Assistant Examiner*—John Calvert
*Attorney, Agent, or Firm*—Ladas & Parry

[57] ABSTRACT

The saw tooth strips which form the card clothing are supported in bar shaped carriers. The carriers are mounted in the frame. This frame includes a blade supporting section for a dirt removing blade. The angular position of the blade relative to the carding cylinder can be adjusted by shims placed selectively onto projections at the blade supporting section. The blade is mounted by set screws to the frame. These set screws project through oblong holes through the blade such that longitudinal adjustments of the blade is possible allowing an adjusting of the distance between the blade knife edge and a carding cylinder.

2 Claims, 2 Drawing Sheets

CARD FLAT SEGMENT HAVING A DIRT SEPARATOR FOR CARDING MACHINES

BACKGROUND OF THE INVENTION

1. FIELD OF THE INVENTION

The present invention relates to a card flat segment for carding machines, which card flat segment includes a frame, a dirt separator and at least one bar shaped carrier for receipt of the saw tooth strips forming the card clothing, which at least one carrier is releasably and adjustably mounted in said frame.

2. DESCRIPTION OF THE PRIOR ART

Dirt separators are used in carding machines for stripping of dirt particles, particles of husk and husk neps etc. off cotton fibers in order to eliminate contaminants prior to a following spinning process. This stripping off proceeds mechanically and a suction apparatus is arranged after the stripping off member by means of which the particles which have been separated are removed. This stripping off is accomplished by the use of blades of a wear-resistant hardened steel, and the distance between the knife edge of such blade and the tips of the clothing of the carding cylinder is extremely close, for instance in the range of 0.05–0.1 mm. This necessitates precise adjusting of the position of the separating blade. Furthermore, the angle defined between the plane determined by the blade and a tangent plane extending through the line of intersection between the first named plane and the envelope of the carding cylinder amounts to about 45°. The smaller this angle is, the greater is the separation of dirt, but simultaneously, the amount of fibers removed also increases. On the other hand, a larger angle leads to a smaller separation of dirt. It is accordingly necessary that this angle can be adjusted precisely. The dirt separator of generally known carding machines is formed by a separate apparatus which occupies space along the carding cylinder and necessitates considerable adjustments during its assembly, during its maintenance and during the exchanging of worn parts.

SUMMARY OF THE INVENTION

A general object of the invention is to provide a compact designed of a dirt separator for carding machines with expenditures to low expenditures for its maintenance and which, furthermore, allows simple adjustments thereof.

A further object of the present invention is to provide a card flat segment for carding machines which has a blade supporting section and which includes a dirt removing blade adjustably arranged on the blade supporting section and which extends into a dirt separating chamber mounted on the frame. The dirt removing blade includes a knife edge at its end facing the carding cylinder of the carding machine.

Still a further object of the present invention is to provide a card flat segment for carding machines in which a blade supporting section comprises a plurality of projections which include blade supporting surfaces and a plurality of threaded holes, and including a set of shims to be selectively placed onto the blade supporting surfaces for selecting the angular position of the blade relative to the carding cylinder of the carding machine. The blade further comprises oblong holes for the receipt of set screws screwed into the threaded holes by means of which the blade is affixed to the blade supporting section. The oblong holes allow adjusting of the blade for the selecting of the distance between the knife edge and the carding cylinder.

A further object of the present invention is to provide a card flat segment for a carding machine in which the dirt removing blade is mounted on the blade supporting section at one of the blade ends by sliding pivot joints having oblong holes and at the other blade end by set screws projecting into further oblong holes arranged in the blade thereby allowing adjusting and selecting of the angular position of the blade relative to a carding cylinder of the carding machine. The oblong holes of the sliding pivot joints are aligned with the further oblong holes in the blade thereby allowing adjusting of the blade for selecting the distance between the knife edge and the carding cylinder.

A further object of the invention is to provide a card flat segment for carding machines which includes a plurality of bar shaped carriers arranged sequentially in the direction of carding, wherein gaps are present between individual carriers, which gaps communicate with the dirt separating chamber by means of through bores arranged in the frame.

DETAILED DESCRIPTION OF THE PREFERRED EMBODIMENTS

Figure 1:
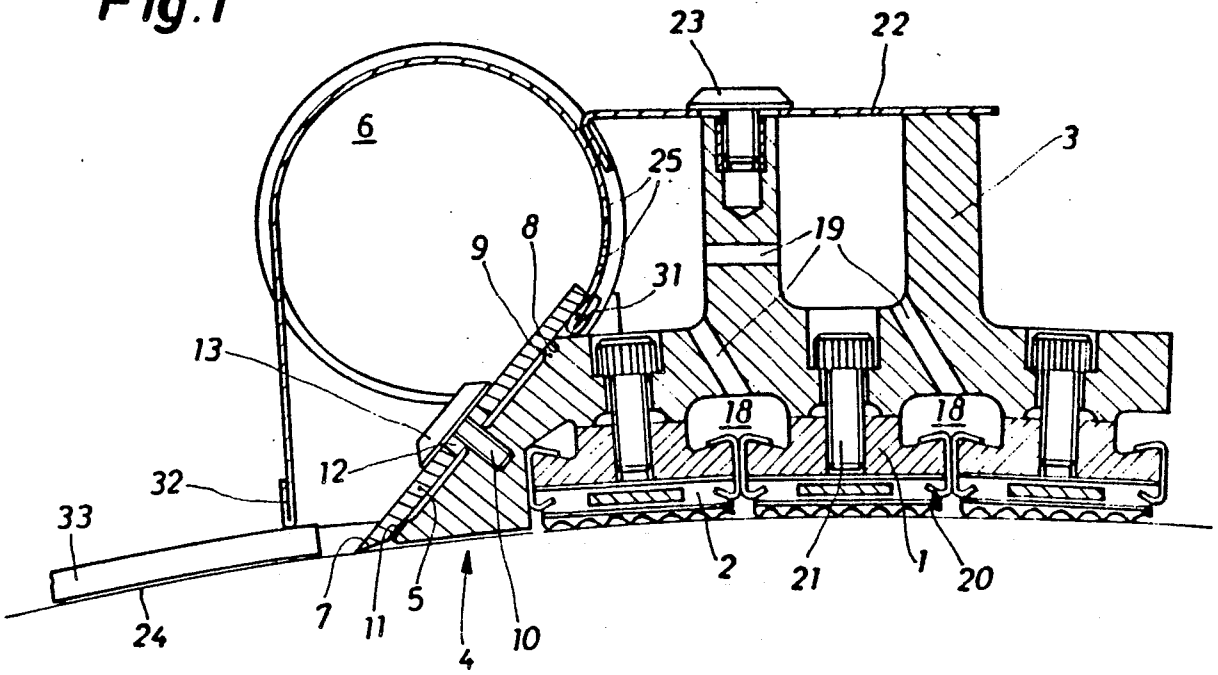
FIG. 1 illustrates a cross section through a first embodiment of a card flat segment having a dirt separator.

Structural members of the two figures which correspond to each other are identified by the same reference numerals.

Reference numeral 1 designates in both figures a bar shaped carrier which supports, according to the generally known technique, the saw tooth strips 2 forming the card clothing which are mounted via well-known clips 20 to the bar shaped carrier 1. Each respective bar shaped carrier 1 is mounted via cap screws to a frame 3 common to all carriers 1 such that its position may be adjusted. The frame 3 is covered by a top blade 22 which is screwed onto the frame 3 by means of further cap screws 23.

The frame 3 is designed such that it includes a blade supporting section 4 which supports the blade 5 which strips off contaminents from the fibers being handled. The carding cylinder which rotates relative to this card flat segment of a revolving flat card, at a speed of several 100 rpm, is identified by the reference numeral 24.

The blade 5 extends into a dirt separating chamber 6 which is basically a suction tube subjected to an induced draft by means of which the stripped off contaminant particles are transported away. The blade 5 includes a knife edge 7, where the distance between the knife edge 7 and the tips of the card clothing wound on to the carding cylinder is between 0.05–0.1 mm.

Attention is now drawn specifically to FIG. 1. The frame 3 comprises at the blade supporting section 4 a plurality of projections 9. The blade 5 is placed onto the projections 9. Shims 11 are used to adjust and set the angular position of the blade 5 relative to an imaginary tangent plane which extends to the line of intersection between the plane defined by the blade 5 and the envelope of the carding cylinder 24. Shims of various thickness are placed as necessary onto one or several of the blade supporting surfaces 8 of the projections 9 such that the angular position of the blade 5 relative to the carding cylinder 24 can be set simply and speedily. The blade 5 is mounted on the blade supporting section 4 by means of set screws 13, through corresponding threaded holes 10. The blade 5 is equipped with oblong holes 12 such that the blade can be transversely moved towards or away from the carding cylinder so that the distance between the knife edge 7 of the blade 5 and the tips of the card clothing of the carding cylinder can be set precisely and simply.

The illustrated embodiment indicates gaps 18 between the bar shaped carriers 1. The gaps 18 communicate via through bores 19 located in the frame 3 and holes 25 in the wall of the dirt separating chamber 6 with the inner space thereof such that fine dust which accumulates in these gaps 18 will also be transported away by suction.

The dirt separating chamber 6 has a cube like configuration and a butt along a section of its wall sealing the top plate 22. The top plate 22 carries the frame 3 at its upper side. The dirt separating chamber 6 extends, furthermore, with a wall section 31 behind the blade 5. A further wall section 32 of the dirt separating chamber 6 rests on a covering plate 33 of the carding cylinder 24. The covering plate 33 ends shortly ahead of the blade 5. Accordingly, the flow path of the air suction carrying the contaminents is exactly defined such that a compact and space-saving structure is provided.

Figure 2:
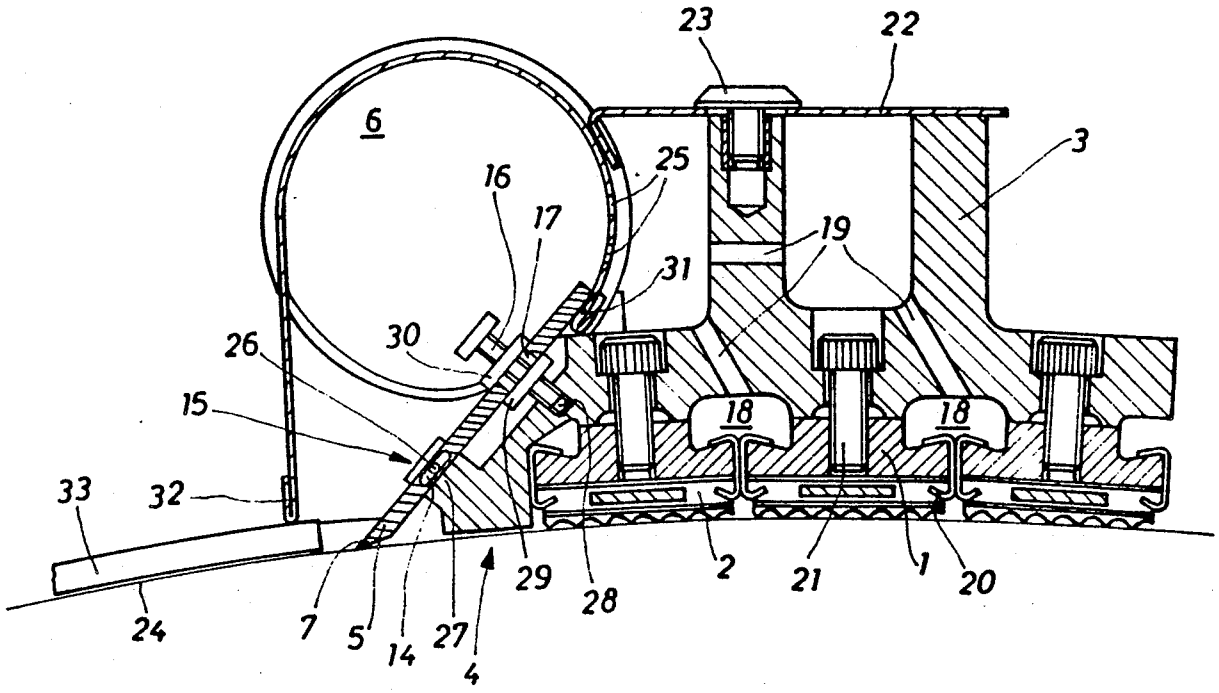
FIG. 2 illustrates a cross section through a further embodiment of a card flat segment having a dirt separator.

Attention is now drawn to FIG. 2 in which a further embodiment of the invention is illustrated. The card flat segment has the same structure as illustrated in FIG. 1 with the exception of a different blade supporting section 4. The blade 5 includes pivot pins 26 which extend through oblong holes 14 in projections 27 of the frame 3 such that sliding pivot joints !5 are formed. Accordingly, it is possible, on the one hand, to pivot the blade 5 together with the pin 26 in the oblong holes 14 and, on the other hand, the blade 5 can be moved towards and away from the carding cylinder 24. A number of set screws 16 extend through the blade 5, and are screwed into respective threaded holes 28 in the frame 3. These set screws 16 project through further oblong holes 17 through the blade 5. These oblong holes 17 are aligned with respective ones of the oblong holes 14 at the lower part of the frame 3 so that the aforementioned sliding motion of the blade 5 relative to the carding cylinder 24 is possible.

The set screws 16 can be designed as micro set screws and the reference numerals 29 and 30 denote discs or small plates whereby the blade 5 rests on the set screw 16 bridging a corresponding oblong hole 17. According to a further embodiment, a set screw 16 is fixedly screwed into the blade supporting section 4, whereby the parts identified by the reference numerals 29 and 39, respectively, comprise nuts (or adjusting nuts), or counter (or lock) nuts. Accordingly, the angular position of the blade 5 relative to the carding cylinder can be selectively adjusted, whereby, during the adjusting movements, the blade 5 can perform a pivoting movement around the respective pins 26.

Based upon the foregoing description, it is clear that those structural members which are subject to wear, the card clothing and the blade can be resharpened and/or exchanged without having to be removed to a distant location. Because the spatial distance between the blade 5 and the saw tooth strips 2 forming the card clothing is extremely close due to the described combination of carding segment and dirt removing unit, a precise adjusting of the blade and the card clothing down to distances of 2/1000 mm is possible, whereby a mutual coordination of the individual working members is possible while a separate adjusting of the members is also possible. The main carrier for the carding segment as well as for the dirt removing unit can be designed as stable as a rigid machine part having a large mass.

The structure of the frame 3 and carrier 1 comprises high strength (or high-tension) extruded aluminum profiles. It is also possible to exchange the complete unit consisting of card clothing, blade, suction tube, etc. as a whole. It is also possible to exchange parts subject to wear, such as, the blade 5, without the necessity of having to readjust those parts which have not been exchanged (e.g., the card clothing). The compact design also allows replacement of parts at a low cost and also a checking or controlling of the individual parts subject to wear.

In a further modification, the caps or hollow spaces 18 at the segments communicate with the dirt separating chamber 6. To this end, through bores 19 are drilled in the frame 3 and further through bores 25 in the wall of the tube-shaped dirt separating chamber 6. This allows microscopically fine dust which may be present or accumulated in the gaps 18 to be subject to suction. The illustrated embodiments show a separate top plate 22 mounted on the frame 3 by means of the cap screw 23. It is, however, also possible to form this cap plate 22 integral with the wall of the tube-shaped separating chamber 6 to have a rigid connection between these two members.

While there are herein shown and described preferred embodiments of the invention, it is to be understood that the invention is not limited thereto, but may be otherwise variously embodied and practiced within the scope of the following claims.

I claim:

1. A card flat segment for carding machines comprising a frame, a dirt separator and at least one bar shaped carrier for receipt of the saw tooth strips forming the card clothing of the machine, said carrier being releasably and adjustably mounted in said frame, said frame comprising a blade supporting section including a dirt removing blade adjustably arranged on the blade supporting section and extending into a dirt separating chamber mounted on said frame, said dirt removing blade including a knife edge at the end thereof facing the carding cylinder of the carding machine, said blade supporting section comprising a plurality of projections which include blade supporting surfaces, a plurality of threaded holes, and a set of shims to be selectively placed onto said blade supporting surfaces for selecting the angular position of said blade relative to the carding cylinder of the carding machine, said blade further comprising oblong holes for the receipt of set screws screwed into said threaded holes for securing said blade to said blade supporting section, said oblong holes allowing adjustment of said blade for selecting the distance between said knife edge and the carding cylinder.

2. A card flat segment for carding machines comprising a frame, a dirt separator and a plurality of bar shaped carriers for receipt of the saw tooth strips forming the card clothing of the machine, said carrier being releasably and adjustably mounted in said frame, said frame comprising a blade supporting section including a dirt removing blade adjustably arranged on the blade supporting section and extending into a dirt separating chamber mounted on said frame, said dirt removing blade including a knife edge at the end thereof facing the carding cylinder of the carding machine, and said bar shaped carriers being arranged sequentially in the direction of carding, gaps being present between individual ones of said carriers, and said gaps communicating with said dirt separating chamber by means of through bores arranged in said frame.

* * * * *